US005669602A

United States Patent [19]

Ito

[11] Patent Number: 5,669,602

[45] Date of Patent: Sep. 23, 1997

[54] VENEER HOISTING APPARATUS

[75] Inventor: Akira Ito, Obu, Japan

[73] Assignee: Meinan Machinery Works, Inc., Obu, Japan

[21] Appl. No.: 617,130

[22] Filed: Mar. 18, 1996

[30] Foreign Application Priority Data

Mar. 30, 1995 [JP] Japan ..... 7-099526

[51] Int. Cl.[6] ..... B65H 3/22

[52] U.S. Cl. ..... 271/18.3; 414/796.9; 294/61

[58] Field of Search ..... 414/796.7, 796.9; 271/18.3; 294/61

[56] References Cited

U.S. PATENT DOCUMENTS

| | | | |
|---|---|---|---|
| 4,165,811 | 8/1979 | Mainvielle | 271/18.3 |
| 5,273,268 | 12/1993 | Ogata | 271/18.3 |

FOREIGN PATENT DOCUMENTS

| | | | |
|---|---|---|---|
| 52-15060 | 2/1977 | Japan | 271/18.3 |
| 57-15775 | 4/1982 | Japan . | |
| 177838 | 10/1983 | Japan | 271/18.3 |
| 207231 | 12/1983 | Japan | 271/18.3 |
| 190138 | 10/1984 | Japan | 271/18.3 |
| 1406103 | 6/1988 | Russian Federation | 271/18.3 |
| 1461731 | 2/1989 | Russian Federation | 271/18.3 |
| 1675175 | 9/1991 | Russian Federation | 271/18.3 |

*Primary Examiner*—Karen B. Merritt
*Assistant Examiner*—Douglas Hess
*Attorney, Agent, or Firm*—Armstrong, Westerman, Hattori, McLeland & Naughton

[57] ABSTRACT

A veneer hoisting apparatus in which even a top veneer of piled veneers is inclined, a piercing unit is adapted to the inclination to pierce and hoist the veneer by piercing members. The veneer hoisting apparatus comprises: a piercing unit with a sharp piercing member; an elevating member for vertically moving the piercing unit fixed thereto; a device for supporting the elevating member, the supporting device having an angle adjusting mechanism for adjusting an angle between the piercing unit and the top veneer when the piercing member contacts the top veneer; and a controller for controlling motion of the elevating member.

8 Claims, 19 Drawing Sheets

VENEER HOISTING APPARATUS

BACKGROUND OF THE INVENTION

1. Field of the Invention

The present invention relates to a veneer sheet hoisting apparatus.

2. Description of the Related Art

Many surfaces of veneer sheet (hereinafter referred to as "veneers") piled on a piling table tilt due to the disorder of the veneers. As a hoisting apparatus adapting a piercing member to the tilting surface of the veneer to pierce the veneer, an apparatus illustrated in FIGS. 1 to 4 is publicly known. In the conventional apparatus, a piercing unit 22 with sharp piercing members 22*a*, 22*b* is rotatably supported by a piston rod of a cylinder 26 through a shaft 23, and a mounting portion 26*c* of the cylinder 26 is rotatably supported through a shaft 27. The piercing members 22*a*, 22*b* project from a lower portion 22*c* of the piercing unit 22 by substantially the same length as the thickness of a veneer, and the piercing unit 22 vertically reciprocates by the action of the cylinder 28 to pierce and hoist a piled veneer 5.

In the above-mentioned apparatus, however, following problems arise. The conventional apparatus will hereinafter be explained with reference to FIGS. 1 to 4. As the piston rod of the cylinder 26 is extended, the piercing member 22*a* pierces the inclined veneer 5. When the piston rod is further extended, the piercing unit 22 rotates counterclockwise about the piercing member 22*a*, and the cylinder 26 rotates clockwise about the shaft 27 to cause the piercing member 22*b* also pierces the veneer 5. Under this condition (FIG. 3), if the extension (one-dot chain line) of the center line of the cylinder 26 shifts left from the piercing member 22*b*, the piercing unit 22 rotates counterclockwise about the piercing member 22*b* and falls so that the veneer fails to be pierced. Further, as shown in FIG. 4, when a bottom portion 22*c* of the piercing unit 22 is formed in such a manner as to have projecting portions at horizontally outer ends of the piercing members 22*a*, 22*b*, and the piled veneer 5 is provided with a concave portion. Therefore, while the piercing members 22*a* and 22*b* fall into the concave portion, the bottom portion 22*c* is blocked by the surface of the veneer 5, which prevents the veneer 5 from being pierced at the concave portion by the piercing members 22*a* and 22*b*.

SUMMARY OF THE INVENTION

This invention has been made to eliminate the problems described above, and the object thereof is to provide a veneer hoisting apparatus which comprises: a piercing unit with a sharp piercing member; an elevating member for vertically moving the piercing unit which is fixed thereto; supporting means for supporting the elevating member, the supporting means having an angle adjusting mechanism for adjusting an angle between the piercing member and the top veneer when the piercing unit contacts the top veneer; and a controller for controlling motion of the elevating member.

In the veneer hoisting apparatus, the supporting means comprises: a first supporting member for supporting the elevating member; a second supporting member for rotatably supporting the first supporting member about an axis which is in parallel with a line extending in a direction of fiber of the veneer, the second supporting member usually staying at a predetermined position, and moving in a direction perpendicular to the fiber of the veneer when a force stronger than a predetermined value is applied to the second supporting member; and a returning mechanism for returning the second supporting member to the predetermined position in a direction perpendicular to the fiber of the veneer.

Further, in the veneer hoisting apparatus, the returning mechanism comprises: a supporting portion fixed to transporting means for the second supporting member; and a plurality of elastic members situated on both sides of the supporting means, each of the plurality of elastic members is fixed to the supporting portion at an end thereof, and is fixed to the second supporting member at the other end thereof.

In the above-mentioned veneer hoisting apparatus, elastic members may be tension springs.

Further, in the veneer hoisting apparatus, the supporting means may include a rotary supporting member for rotatably supporting the elevating member about an axis which is in parallel with a line extending in a direction of fiber of the veneer, the rotary supporting member being rotatable about another axis which is in parallel with a line extending in a direction of fiber of the veneer, and a force produced by the elevating member for lowering the piercing unit is lower than gravity applied to total own weight of an immovable portion of the elevating member and a rotary supporting member.

Further, in the veneer hoisting apparatus, the rotary supporting member and the elevating member may preferably be connected to each other with a universal joint.

Still further, in the veneer hoisting apparatus described above, the supporting means includes a guide support member for rotatably supporting the elevating member about an axis which is in parallel with a line extending in a direction of fiber of the veneer, the guide support member having an inclined portion for guiding the elevating member in a direction of the inclined portion.

Still further, in the veneer hoisting apparatus, the guide support member comprises: an inclined surface with a central portion at the lowest level and ascending surfaces on both sides of the central portion; and stoppers for restricting movement of the elevating member at both ends of the inclined surface.

With the above-mentioned construction, even if the top veneer of piled veneers tilts, the piercing unit is stably adapted to the tilting surface of the veneer to hoist the veneer while piercing by the piercing member.

When the elevating member works to cause the piercing unit to fall toward an inclined portion of a top veneer from the upside of piled veneers, a part of the piercing member or a part of a bottom portion of the piercing member, or both of them abut the veneer. As the piercing unit is kept on falling, the piercing unit and the elevating member tilt in the same direction about the part of the piercing member of the part of the bottom portion of the piercing unit, or both or them in accordance with the inclination of the top veneer of the piled veneers. Then, the piercing unit is adapted to the inclination of the veneer to allow the piercing member to pierce the veneer, and simultaneously most of the bottom portion of the piercing unit abut the veneer, and the movement of the piercing unit and the elevating member are restricted while maintaining their inclination. Then, the elevating member works to elevate the piercing unit, so that the pierced veneer is hoisted.

BRIEF DESCRIPTION OF THE DRAWINGS

The present invention will be more apparent from the following description with reference to the accompanying drawings wherein:

FIG. 18 is another view for explaining the motion of the primary portion of the veneer hoisting apparatus according to the third embodiment.

DETAILED DESCRIPTION OF PREFERRED EMBODIMENTS

Figure 5:
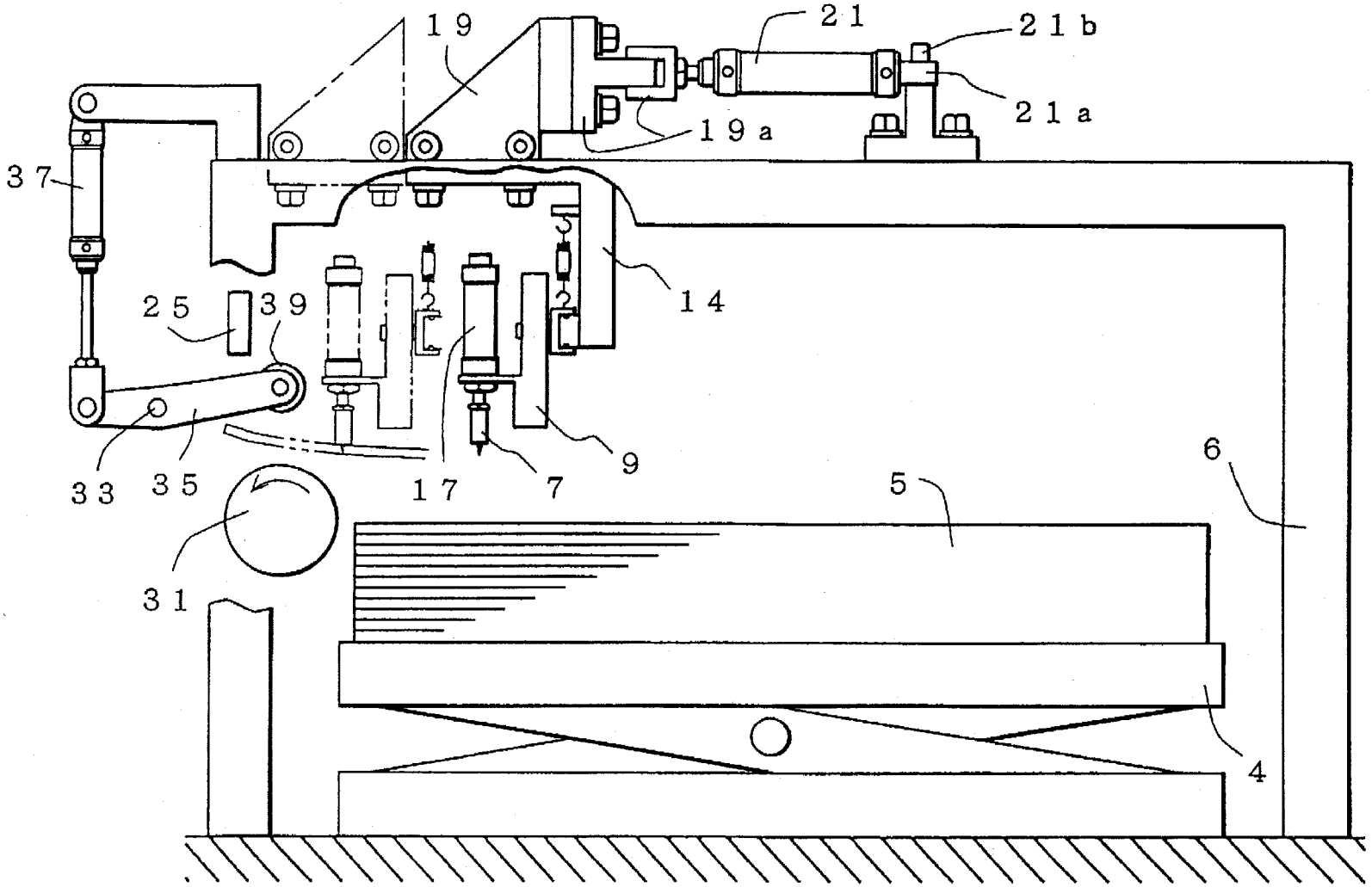
FIG. 5 is an overall side view of the veneer hoisting apparatus according to the first embodiment the present invention.
Figure 6:
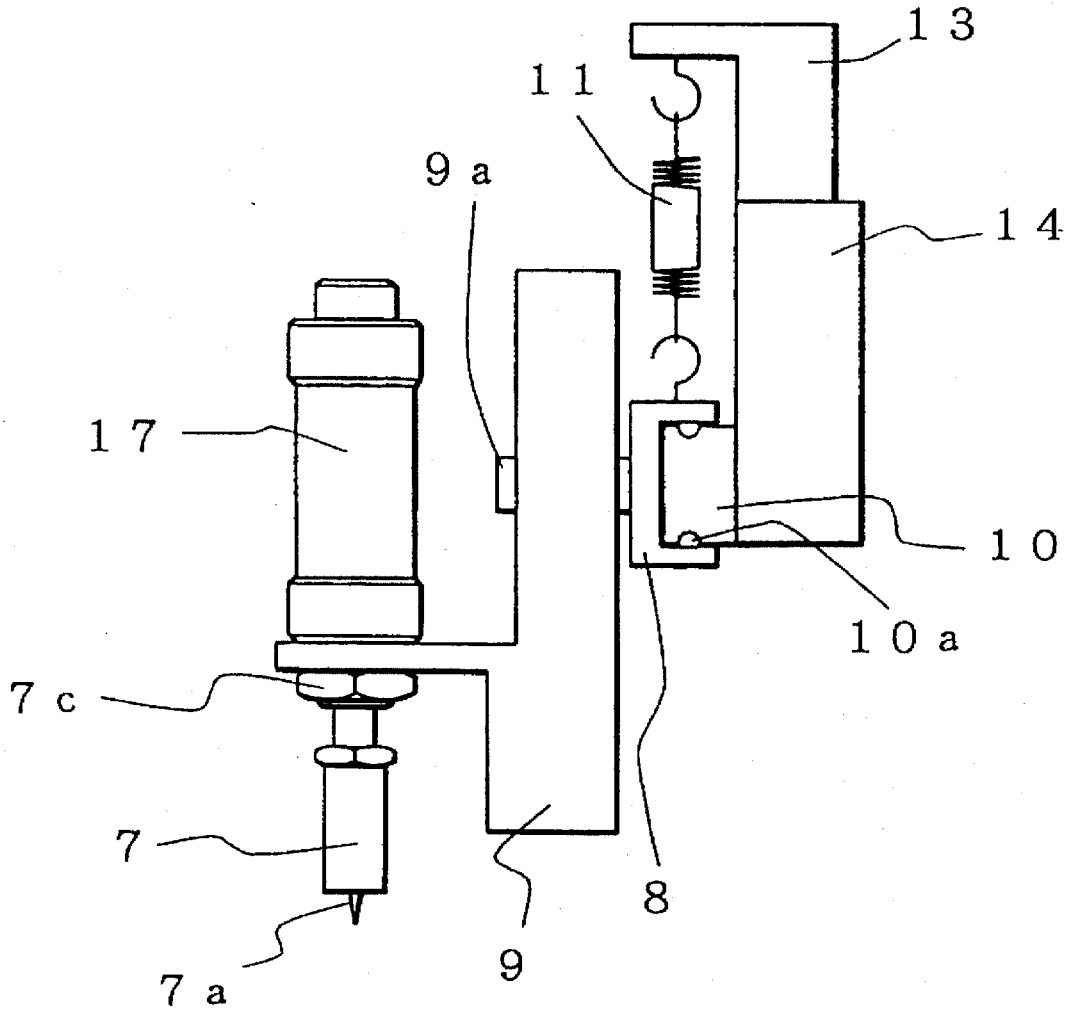
FIG. 6 is an enlarged view of a primary portion of the veneer hoisting apparatus shown in FIG. 5.
Figure 7:
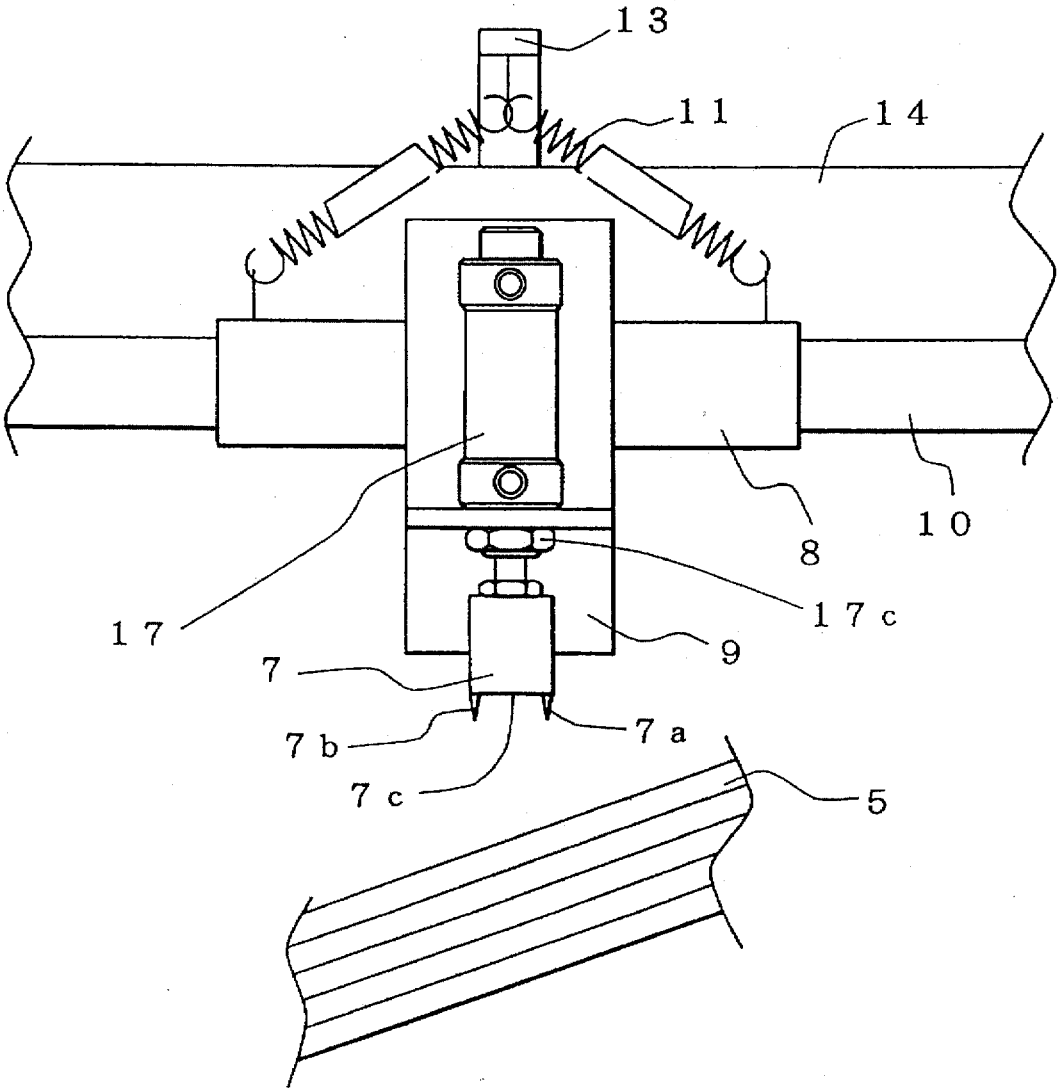
FIG. 7 is a front view of the veneer hoisting apparatus illustrated in FIG. 5.

A veneer hoisting apparatus according to the first embodiments of the present invention will be explained with reference to FIGS. 5 to 10. FIG. 5 is an overall side view of the veneer hoisting apparatus, and FIG. 6 is an enlarged view of a primary portion of the veneer hoisting apparatus shown in FIG. 5, and FIG. 7 is a front view of the veneer hoisting apparatus illustrated FIG. 6, and FIGS. 8 to 10 show the motion of the primary portion.

Figure 1:
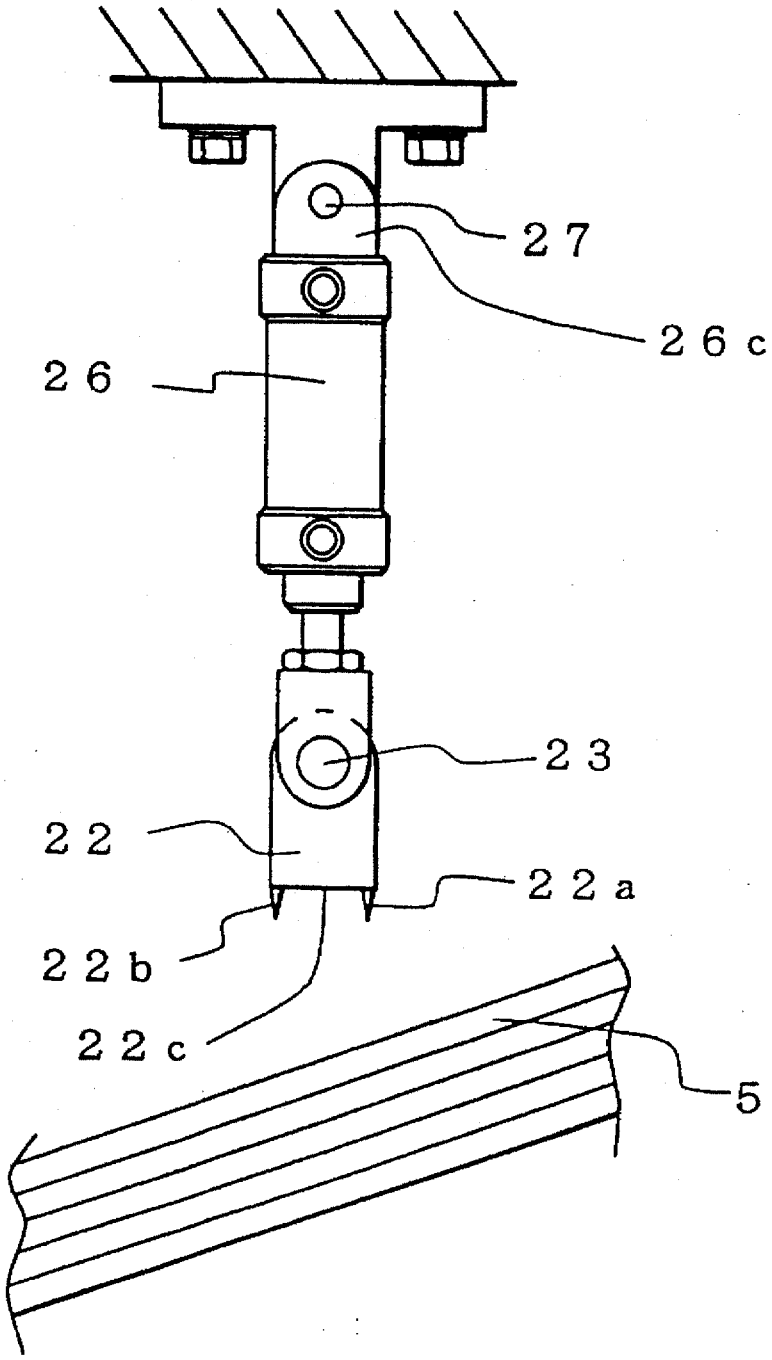
FIG. 1 PRIOR ART
FIG. 1 is a drawing for explaining a conventional veneer hoisting apparatus.
Figure 2:
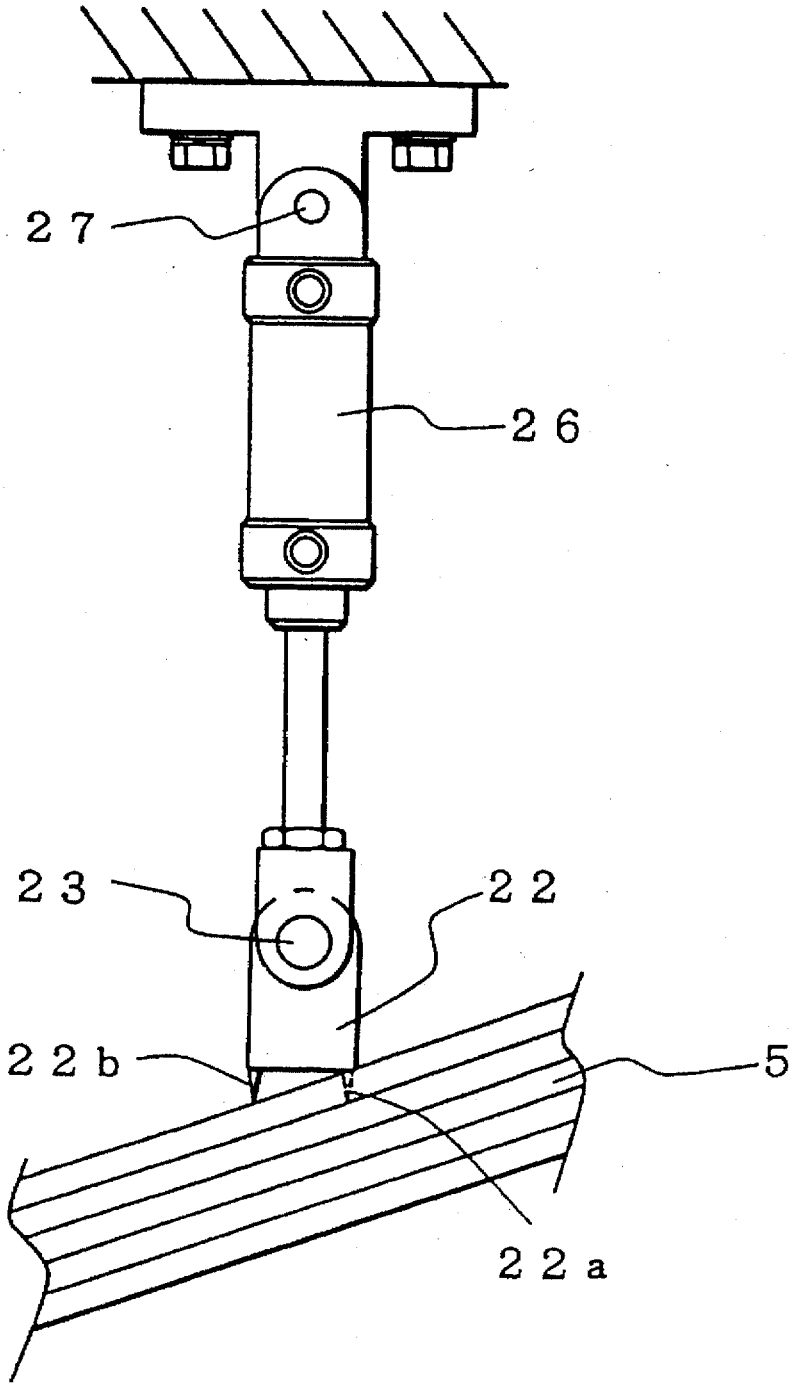
FIG.2 PRIOR ART
FIG. 2 is a drawing for explaining said conventional veneer hoisting apparatus in which one of the piercing members pierces the veneer thereunder.
Figure 3:
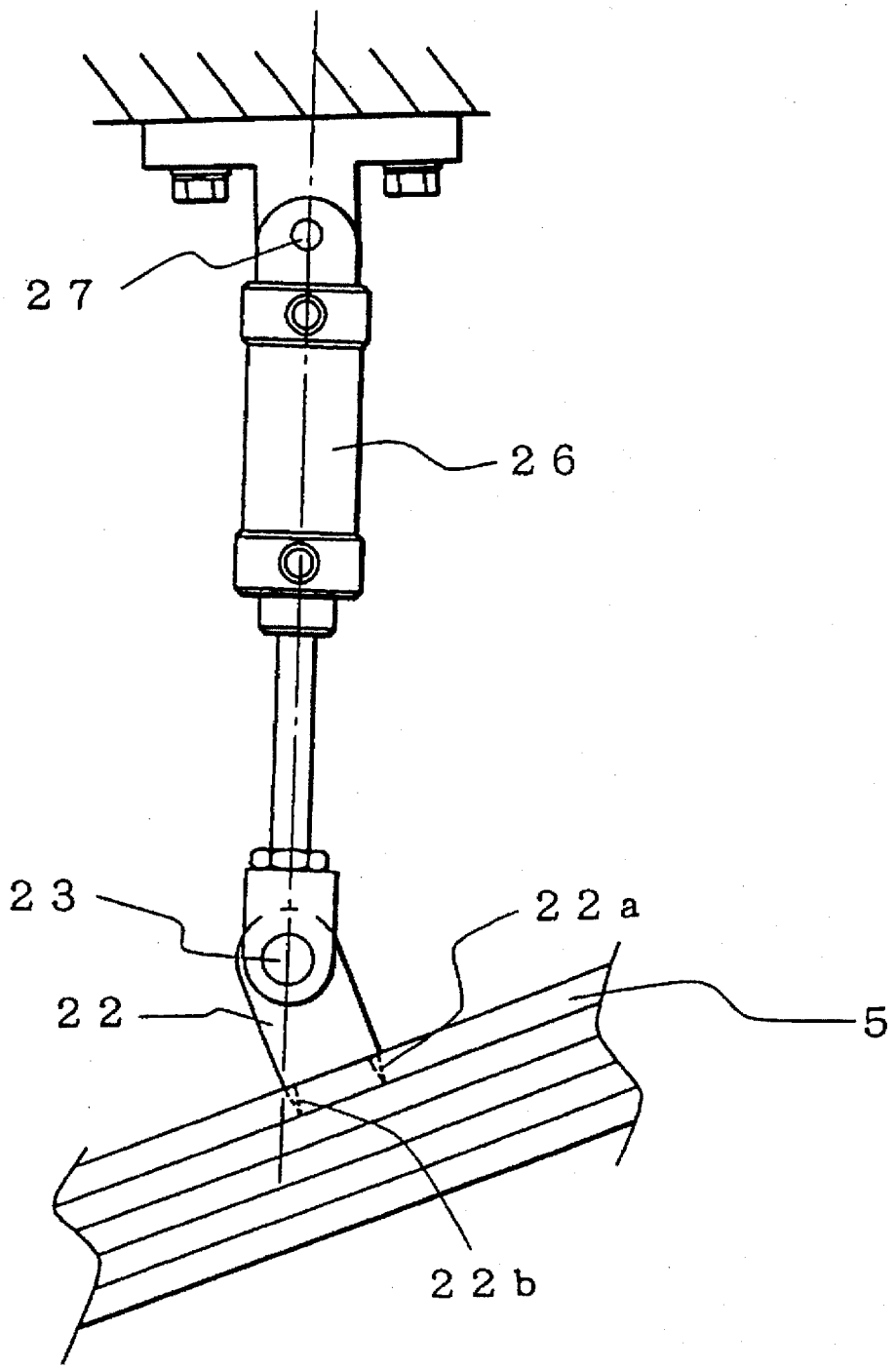
FIG.3 PRIOR ART
FIG. 3 is a drawing for explaining said conventional veneer hoisting apparatus in which two piercing members pierce the said veneer.
Figure 4:
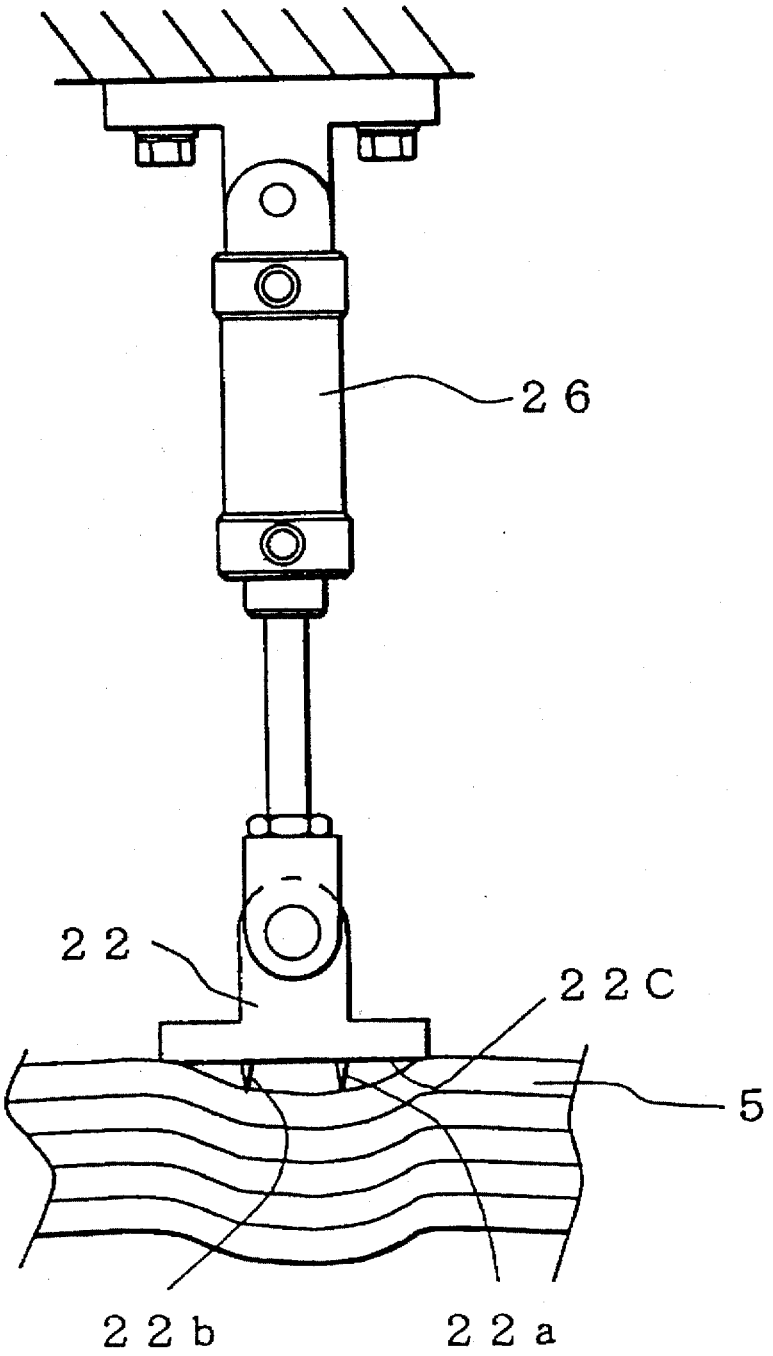
FIG. 4 PRIOR ART
FIG. 4 is a drawing for explaining another conventional veneer hoisting apparatus in which the piercing unit is blocked by the unevenness of the veneer with the result that the piercing members will not stab the veneer.

At first, the overall construction of the veneer hoisting apparatus will be explained with reference to FIG. 5. Numeral 6 is a body and 5 is a veneer, and the fiber of the veneer directs right and left in FIG. 3. Numeral 4 is a piling table on which the veneers 5 are piled, and a suitable detecting device (not shown) controls the height of the piling table 4 to maintain the position of the top veneer 5 at an optimum height. Numeral 7 is a piercing unit with sharp piercing members, and 17 is an elevating cylinder as elevating member with rotation preventing means for the piston rod. Numeral 9 shows a first supporting member which supports the elevating cylinder 17 and is rotatable as described below, and 19 is a movable frame which is mounted to the body 6 so as to be substantially horizontally movable, and an auxiliary frame 14 is attached to the movable frame 19. Numeral 21 is a horizontally movable cylinder, and a mounting portion 21*a* thereof is mounted to the body 6 through a shaft 21*b*, and the piston rod is attached to the movable frame 19 through a joint 19*a*. Numeral 25 is a photo cell or a limit switch as a detector to detect a veneer, and 31 is a discharging roller for transporting the veneer 5 to the next process. This roller 31 is rotatable (not shown) and is mounted to the body 6 and is connected to a motor (not shown). Numeral 39 is a striking roller for supporting the veneer 5 in combination with the discharging roll 31, and the striking roller 39 is rotatably supported on an end of an arm 35. The arm 35 is rotatably supported through a shaft 33 fixed to the body 6, but this construction is not illustrated in drawings. Further, the other end of the arm 35 and the piston rod of the cylinder 37 are rotatably connected to each other. On the basis of signals which are generated when the photo cell 25 detects the presence of the veneer or the photo cell 25 detects no veneer, a controller (not shown) controls the motion of the elevating cylinder 17, the horizontally movable cylinder 21 and the striking cylinder 37 as described below.

Next, a primary portion of the veneer hoisting apparatus will be explained with reference to FIGS. 6 and 7. Reference symbols 7*a* and 7*b* are sharp piercing members projecting from the bottom portion 7*c* of the piercing unit 7 and are integrally formed with the piercing unit 7 or separately produced from the piercing unit 7 and attached thereto. The piercing unit 7 is connected to the piston rod of the elevating cylinder 17, and the elevating cylinder 17 is attached to the first supporting member 9 through the mounting nut 17*c*. Further, the first supporting member 9 is rotatable by the shaft 9*a* mounted to a second supporting member described below. The total weight of the first supporting member 9, the elevating cylinder 17 and the like substantially vertically maintains the elevating cylinder 17 about the shaft 9*a* as a rotational axis. Numeral 8 is the second supporting member for rotatably supporting the first supporting member 9 through the shaft 9*a*, and is horizontally (right and left in FIG. 7) movable along the rail stand 10 described below. Numeral 10 is the rail stand horizontally and linearly extending as illustrated in FIG. 7, which supports the second supporting member 8 so as to horizontally be movable through a roller 10*a* (FIG. 6). Numeral 11 are tension springs as a returning mechanism for moving the second supporting member to a prescribed position in a direction of the fiber of a veneer as described below. The tension springs 11 are fixed to a fixing stand 13 described below and both ends of the second supporting member 8. Usually, the tension springs 11 restrict the second supporting member 8 at the prescribed position in the direction of the fiber of a veneer where the force produced by the right and left springs 11 balance (where the elevating cylinder positions substantially just below the fixing stand 13 as described below). Numeral 13 shows the fixing stand mounted to the auxiliary frame 14.

Next, the motion of the veneer hoisting apparatus according to the first embodiment will be explained with reference to FIGS. 5 to 10. At first, in the initial state shown by solid lines in FIG. 5, the piston rods of the elevating cylinder 17 and the horizontally movable cylinder 21 are retracted, and the piston rod of the striking cylinder 37 is extended. Then, the piercing unit 7 is positioned over the left end portion of the veneer 5 in the direction of the fiber thereof, and this position is defined as the prescribed position in the direction of the fiber of a veneer. On the other hand, the position illustrated by two-dot chain lines is defined as a standby position before hoisted. Then, based on the detecting signal from the detector 25 which shows whether or not a veneer exists a signal from the controller sets time required to cause the elevating cylinder 17, the horizontally transporting cylinder 21 and the striking cylinder 37 to be retracted or extended by way of delaying device such as timers (not shown) and are outputted from the controller in accordance with the order of the motion.

Figure 8:
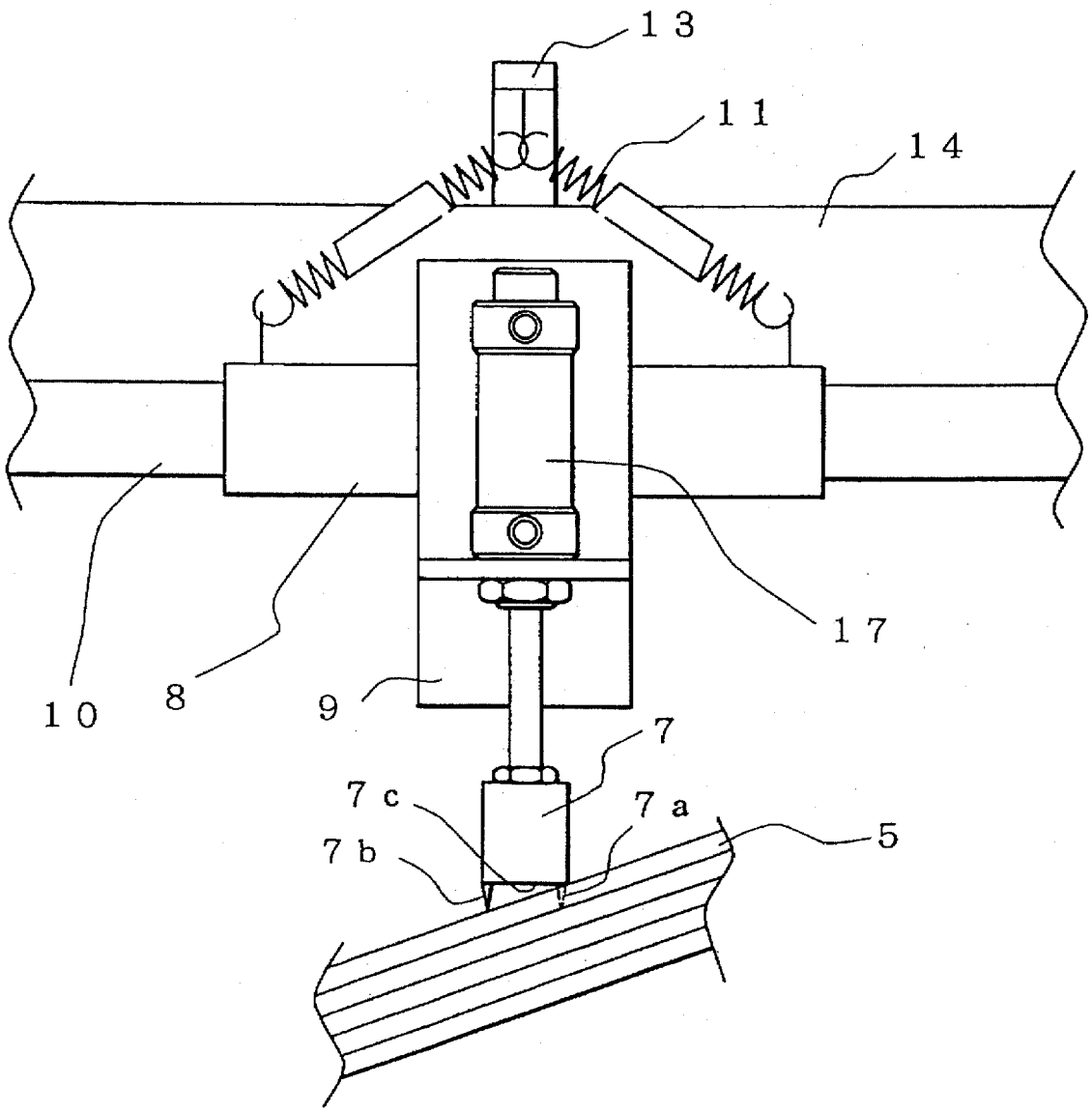
FIG. 8 is a view for explaining the motion of the primary portion of the veneer hoisting apparatus according to the first embodiment.
Figure 9:
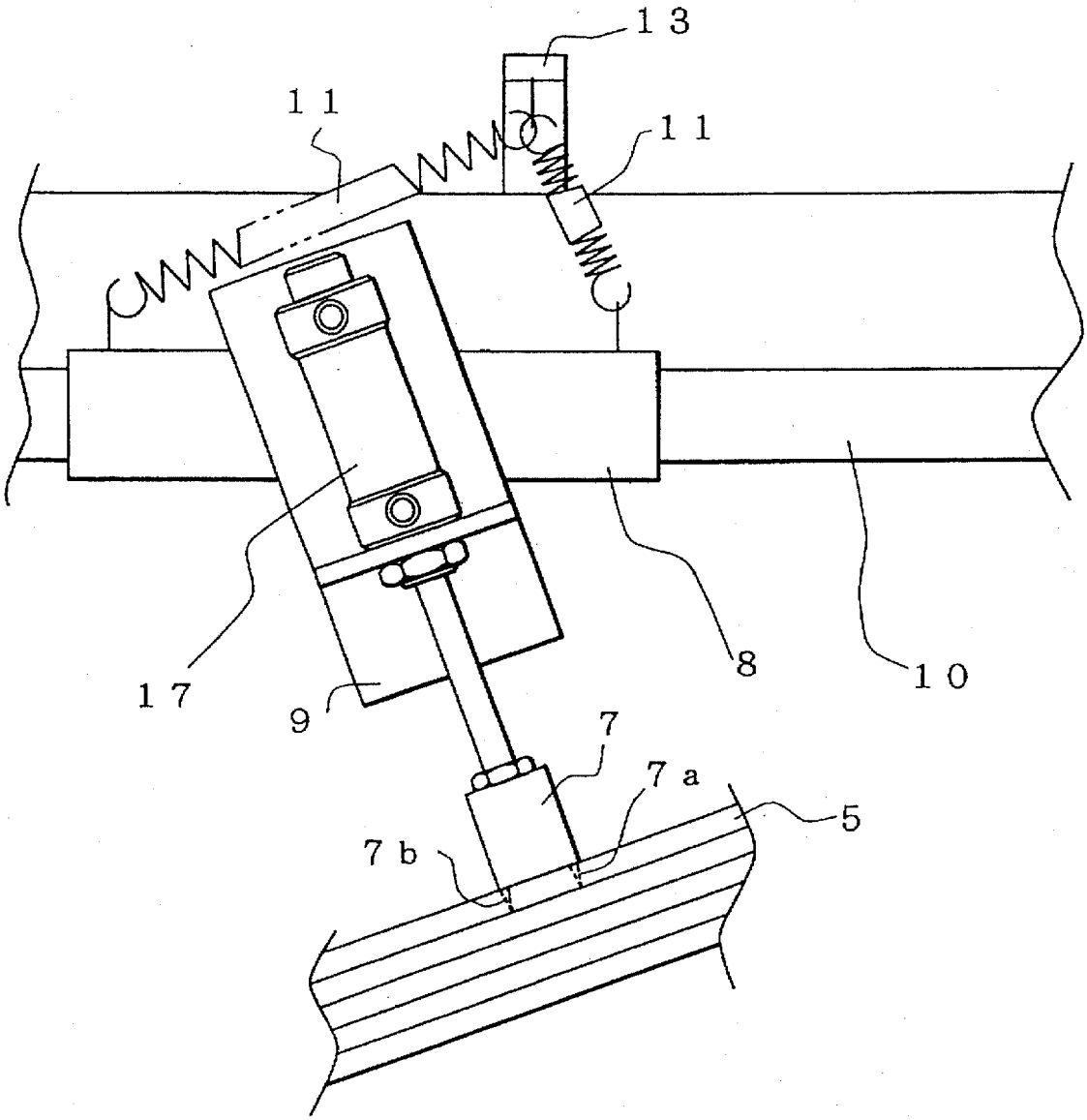
FIG. 9 is a view for explaining the motion of the primary portion of the veneer hoisting apparatus according to the first embodiment.
Figure 10:
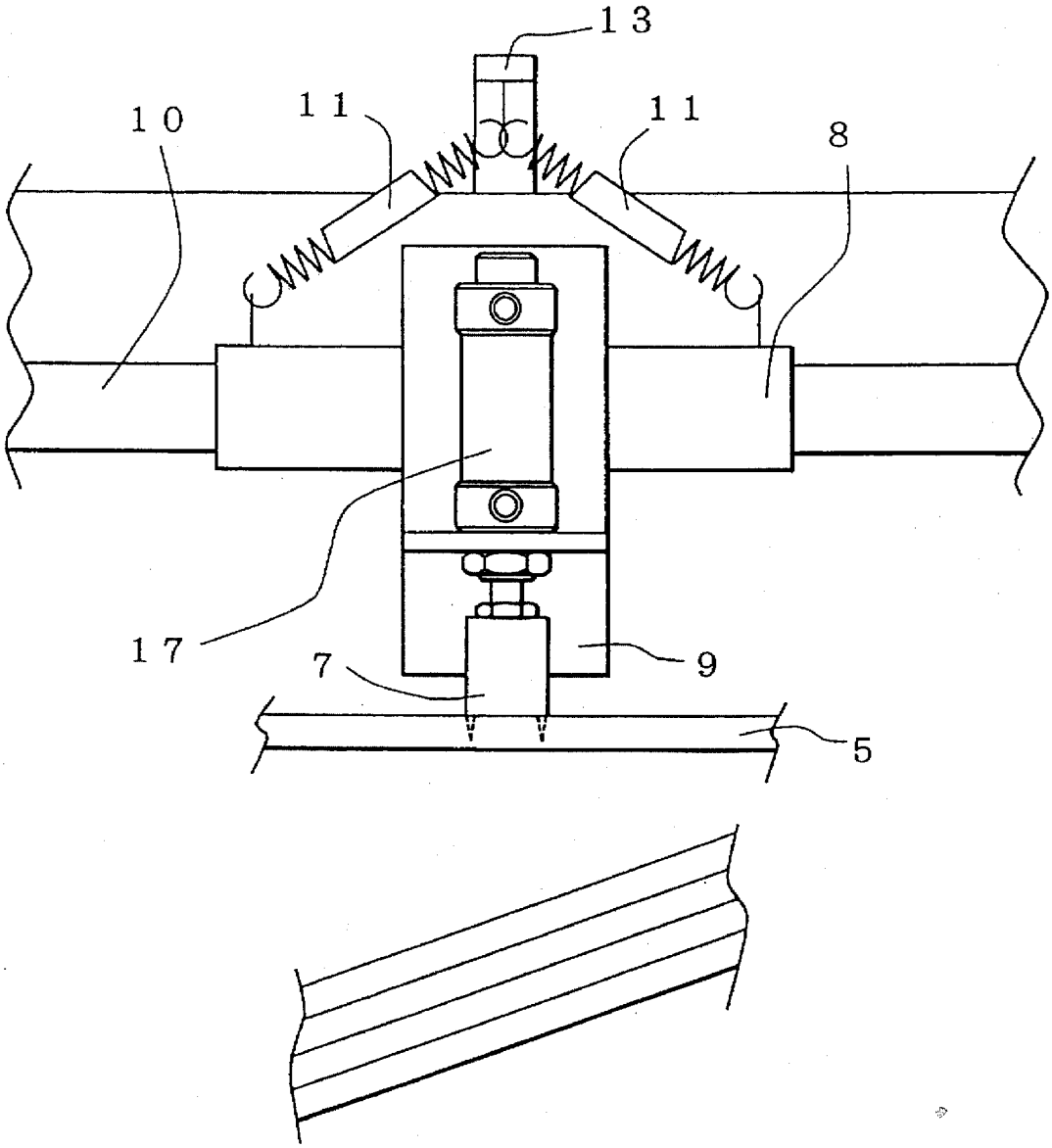
FIG. 10 is a view for explaining the motion of the primary portion of the veneer hoisting apparatus according to the first embodiment.

In initial state, a signal from the detector 25 detecting no veneer is transmitted to the controller. Then, the signal causes the piston rod of the elevating cylinder 17 to be extended, which allows the piercing unit 7 to move downward and to abut the veneer 5. (FIG. 8). If the portion of the top veneer 5 where the piercing unit 7 abuts is inclined, only the piercing member 7*a* pierces the veneer 5, then, the piercing unit 7, the elevating cylinder 17 and the first supporting member 9 rotate counterclockwise above the piercing unit 7*a* such that almost at the same time, the second supporting member 8 also moves left since the piercing member 7*a* receives reaction from the veneer 5, which causes the left tensile spring 11, FIG. 7, to be stretched and the right tensile spring 11 to be shrunk. As the piston rod is further stretched, the piercing member 7*b* also pierces the veneer 5 in accordance with the inclination of the veneer 5, so that the bottom portion, 7*c* of the piercing unit 7 also abuts the veneer 5 (FIG. 9). The abutment described above restricts the extension of the piston rod, and almost at the same time, the movement of the second supporting member 8 toward left is stopped. After this, even if the piercing unit 7 moves downward more or less, the relative position of the piercing unit 7 and the veneer 5 does not change, which allows only one veneer to be pierced by the piercing members 7*a* and 7*b*.

After the time required for the extension of the piston rod passes, a signal from the controller causes the piston rod to be retracted and the piercing unit 7 piercing members 7*a* and 7*b* of which pierces the veneer 5 moves upward. Then, not only the piercing unit 7, the elevating cylinder 17 and the first supporting member 9 rotate clockwise due to their weight, but the above-mentioned reaction is eliminated to cause the second supporting member 8 to move right since the right and left tensile springs will be stretched or shrunk to balance their forces, which allows the second supporting member 8 to be returned to the prescribed position (FIG. 10) in the direction perpendicular to the fiber of a veneer.

After the piston rod of the elevating cylinder 17 is retracted, a signal from the controller causes the piston rod of the horizontally transporting cylinder 21, FIG. 5, to be extended to move the movable frame 19 to transfer the veneer 5 to the standby position before inserted (the portion indicated by the two-dot chain lines in FIG. 5). When the photo cell 25 detects the veneer 5, a signal showing the presence of a veneer is transmitted to the controller from the photo cell 25, and a signal from the controller causes the piston rod of the striking cylinder 37 to be retracted. As a result, the striking roller 39 moves downward to allow the veneer 5 to be drawn from the piercing unit 7 until the veneer 5 is sustained by the roller discharging 31 and the striking roller 39 so as to be transported to the next process. Next, after the piston rod of the striking cylinder 37 is retracted, a signal from the controller causes the piston rod of the horizontally transporting cylinder 21 to be retracted, which allows the movable frame 19 to be returned to the prescribed position in the direction of the fiber of a veneer (the position indicated by the solid lined in FIG. 5). After the transportation of the veneer 5 to the next process is completed, a detecting signal showing no veneer is sent to the controller from the detector 25. Then, a signal from the controller allows the piston rod of the striking cylinder 37 to be extended and returned to the initial state. The above-mentioned motions are repeatedly performed to hoist and transport veneers one after another.

In case that the piercing members 7*a* and 7*b* fail to pierce the veneer 5 for some reason, even if the movable frame 19 and other primary portions were moved to the standby position before inserted, no detecting signal indicating the presence of a veneer would be outputted from the detector 25. At that time, a signal from the controller causes the above elements to be returned their initial states to repeat the same procedure again. Otherwise, if the movable frame 19 was slightly shifted from the prescribed position in the direction of the fiber of a veneer to repeat the above-mentioned motion again, it would be more effective when the piercing members fail to pierce the veneer due to the existence of deficiency such as a knothole.

After the veneer 5 is pierced and is hoisted, the veneer 5 may be sacked by a vacuum device separately provided from the veneer hoisting apparatus and the vacuum device may horizontally be transported to transport the veneer 5.

Elastic body such as compressive springs, cylinders and rubber may substitute for the tensile springs 11 as a returning mechanism.

Figure 11:
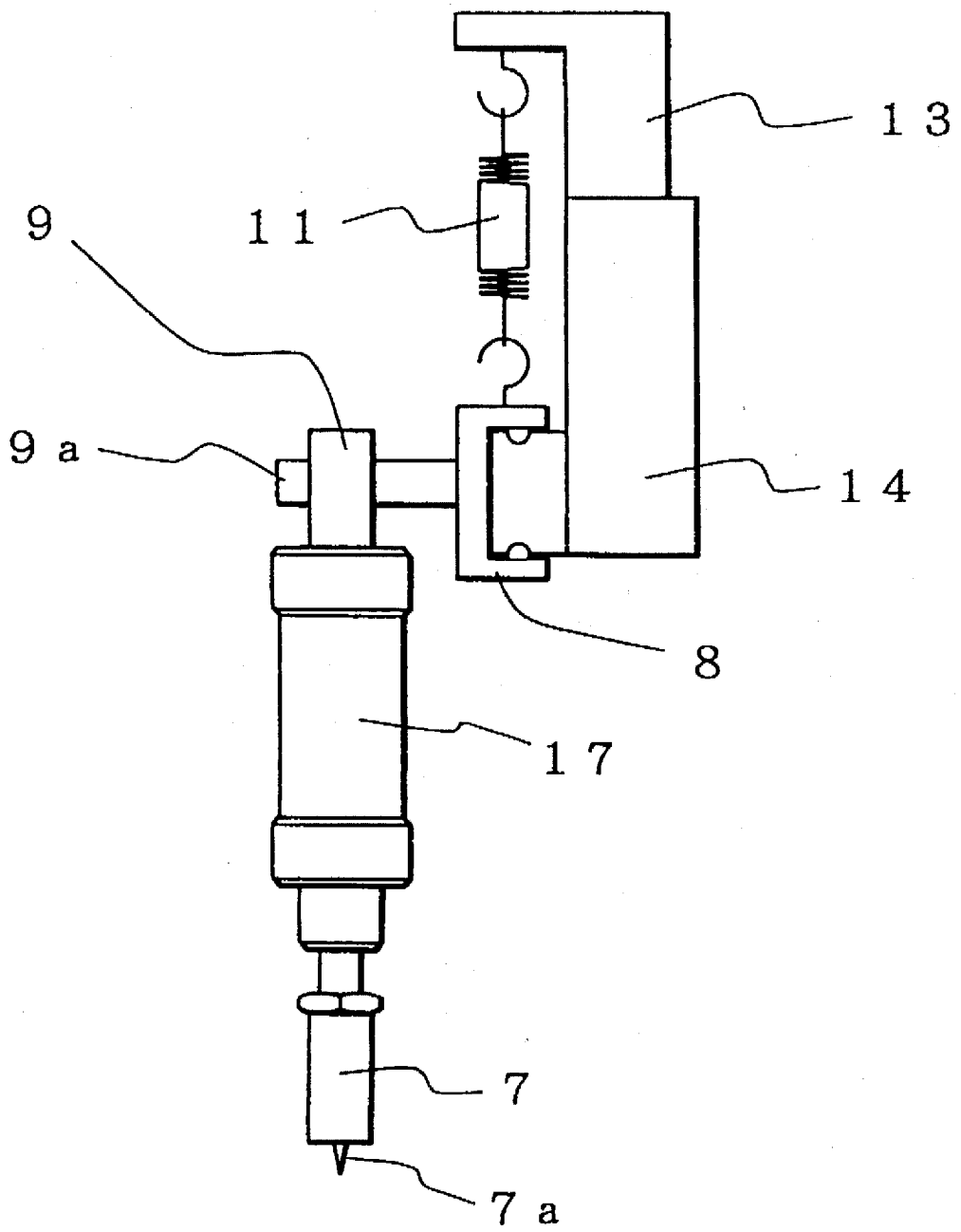
FIG. 11 is a view of the primary portion of the veneer hoisting apparatus according to the first embodiment in which a part of the primary portion is modified.

As illustrated in FIG. 11, the mounting portion of the elevating cylinder 17 may be used as the first supporting member 9 and may rotatably be mounted to the second supporting member 8 through the shaft 9*a*.

As described above, in the first embodiment, even if the piercing unit 7 abuts the inclined portion of the top veneer 5 of the piled veneers, the piercing unit 7 is stably adapted to the inclination to pierce and hoist the veneer 5 through the piercing members 7*a* and 7*b*.

Figure 12:
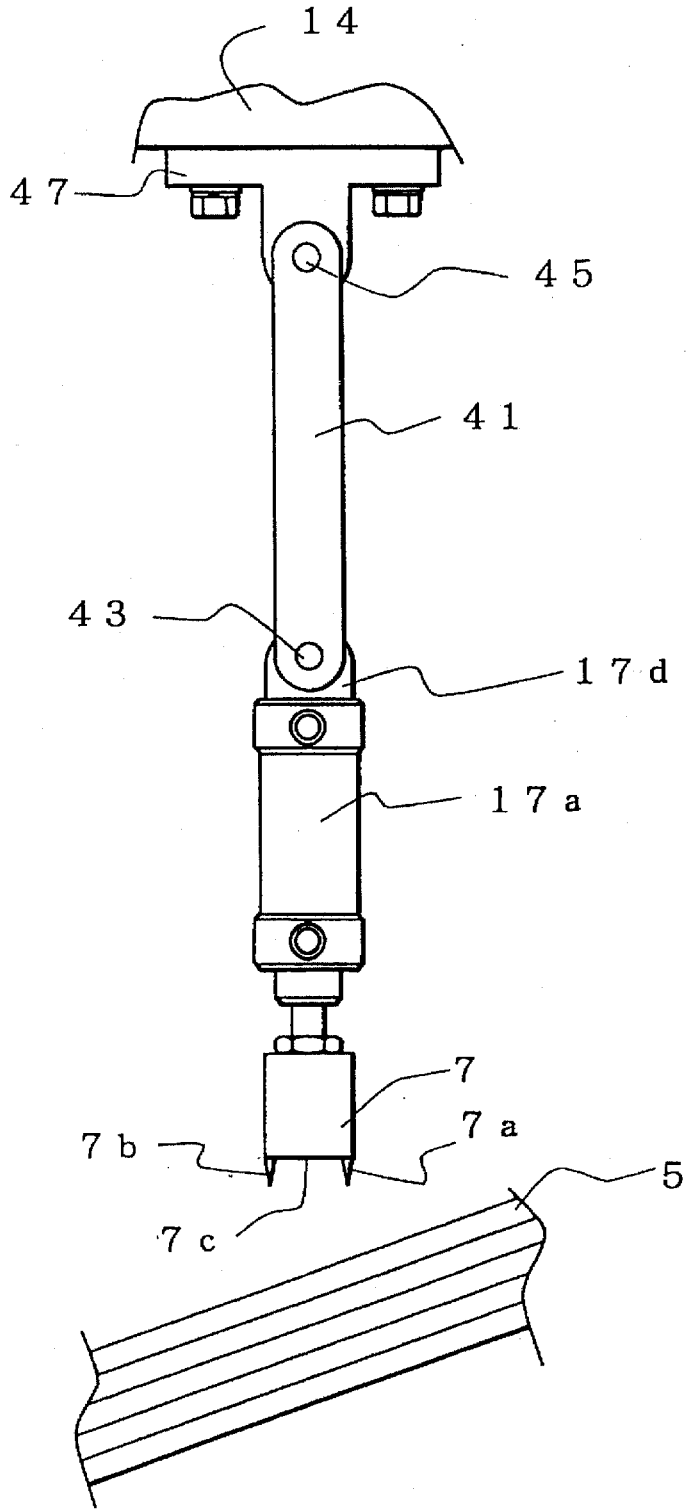
FIG. 12 is a front view of the primary portion of the veneer hoisting apparatus according to the second embodiment of the present invention.

Now, the second embodiment will be explained with reference to FIGS. 12 to 14. FIG. 12 is a front view of a primary portion of a veneer hoisting apparatus according to the present invention, and FIGS. 13 and 14 how the motion of the primary portion. Since constructions and motion of elements other than the primary portion are the same as those of veneer hoisting apparatus according to the first embodiment, the explanation thereof will be omitted.

Like the first embodiment, numeral 7 is a piercing unit with sharp piercing members 7*a* and 7*b*, and 17*a* is an elevating cylinder for the piercing unit 7 as an elevating member. The piston rod of the elevating cylinder 17*a* and the piercing unit 7 are connected to each other. The elevating cylinder 17*a* is provided with a rotation preventing mechanism for the piston rod. The lower end of the rotary supporting member 41 and the mounting portion 17*d* of the elevating cylinder 17*a* are rotatably connected to each other with the shaft 43. Numeral 47 is a supporting metal fixed to the auxiliary frame 14, which supports the upper end of the rotary supporting member 41 through the shaft 45.

In the initial state shown in FIG. 12, the piston rod of the elevating cylinder 17*a* is retracted, and the rotary supporting member 41, the elevating cylinder 17*a* and the piercing unit 7 are vertically arranged due to their own weight.

In the above-mentioned construction, a force which extends the piston rod of the elevating cylinder 17*a* is set lower than gravity applied to the total weight of the cylinder tube, the mounting portion 17*d*, the rotary supporting member 41 and others such that said force will not lift the cylinder tube, the mounting portion 17*d*, the rotary supporting member 41, etc.

Figure 13:
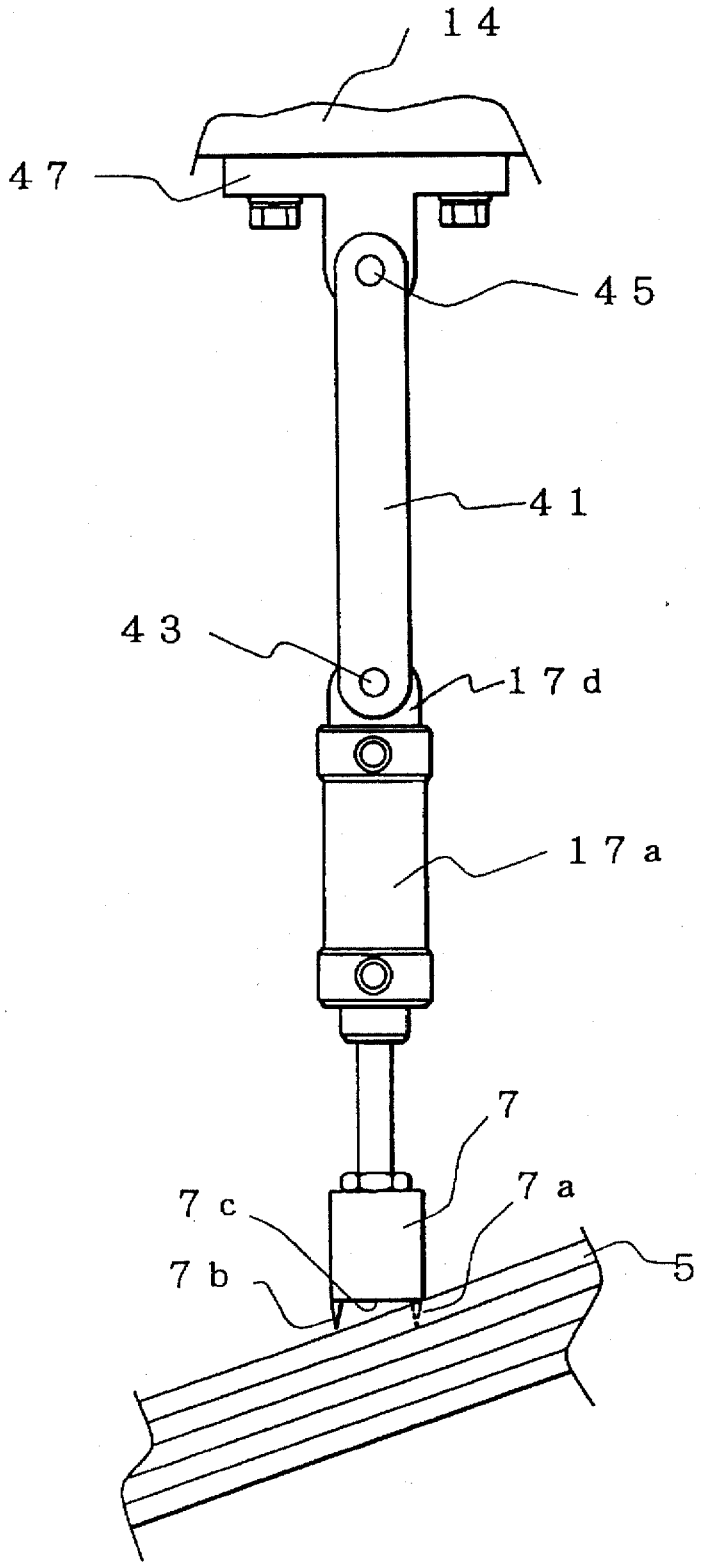
FIG. 13 is a view for explaining the motion of the primary portion of the veneer hoisting apparatus according to the second embodiment.
Figure 14:
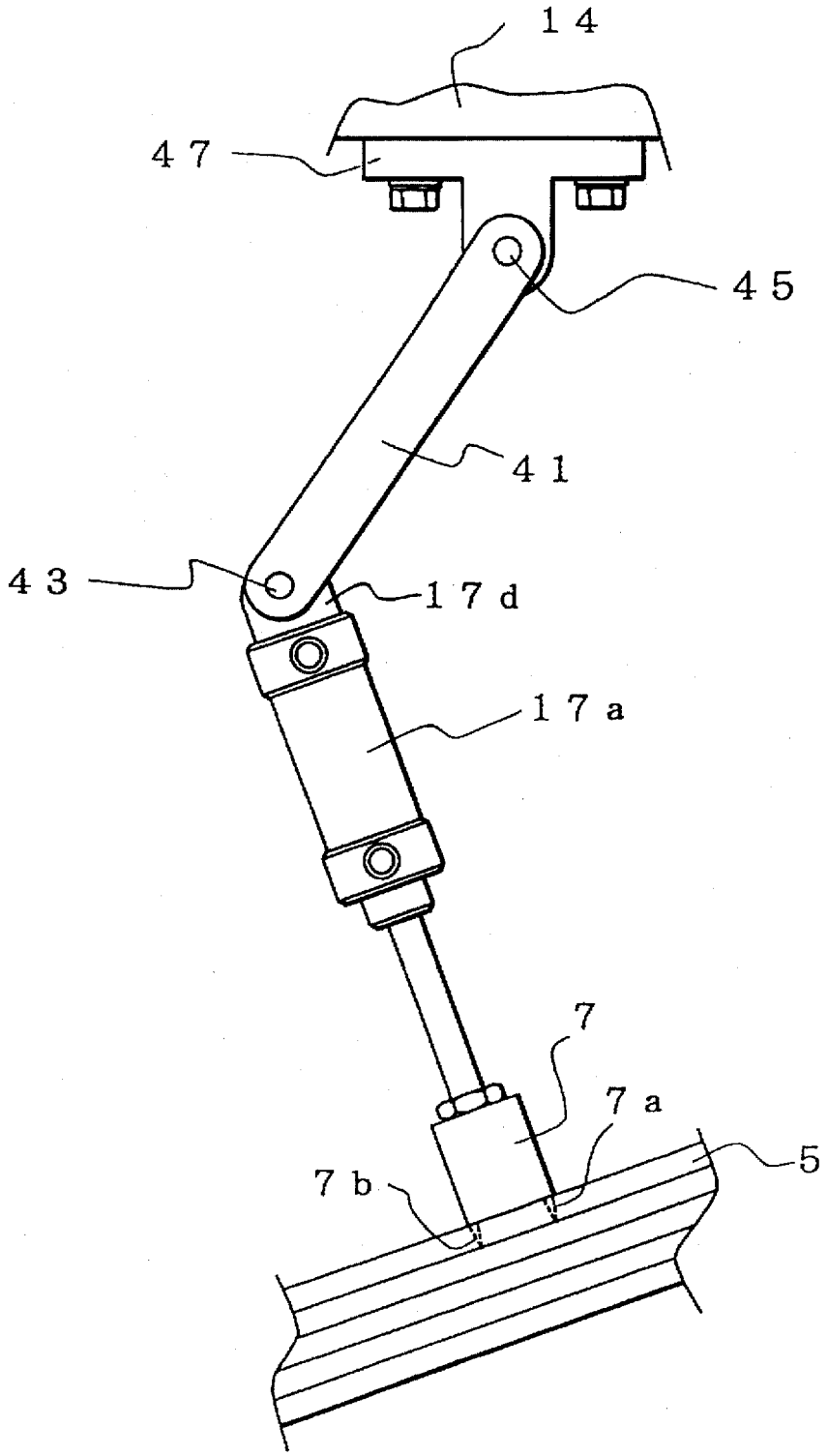
FIG. 14 is another view for explaining the motion of the primary portion of the veneer hoisting apparatus according to the second embodiment.

With the construction described above, like the first embodiment, when a signal from the controller causes the piston rod of the elevating cylinder 17*a* to be extended, the piercing unit 7 falls and the piercing member 7*a* abuts the veneer 5 (FIG. 13). If the surface of the veneer 5 which abuts the piercing member 7*a* is inclined, only the piercing member 7*a* pierces the top veneer 5 such that the piercing unit 7 and the elevating cylinder 17*a* rotate counterclockwise about the piercing member 7*a* while the rotary supporting member 41 rotates clockwise about the shaft 45. Further, as the piston rod is kept on stretching, the piercing unit 7 is adapted to the inclination of the veneer 5 to allow the piercing member 7*b* to pierce the veneer 5, so that the bottom portion 7*c* of the piercing unit 7 contacts the veneer (FIG. 14). The contact causes the rotation of the rotary supporting member 41, the elevating cylinder 17*a* and the elevating cylinder 17 to be ceased. After that, even the piercing unit 7 slightly falls, the relative position between the elevating cylinder 17*a* and the veneer 5 does not change, which allows only one veneer 5 to be pierced through the piercing members 7*a* and 7*b*.

After the time required for the extension of the piston rod passes, like the first embodiment, a signal from the controller causes the piston rod to be retracted, and the piercing unit 7 and the elevating cylinder 17*a* rotate clockwise due to their own weight while the piercing unit 7, which pierces the veneer 5 by the piercing members 7*a* and 7*b*, elevates, and simultaneously the rotary supporting member 41 rotates counterclockwise. The motion thereafter is the same as the first embodiment, so the explanation will be omitted.

In place of the shafts 43 and 45, universal joints, rubber, or springs may be used. In such a case, even if the surface of the veneer 5 is inclined in any direction, the piercing unit 7 can be stably adapted to the inclination of the veneer 5, which causes the piercing members 7*a* and 7*b* to pierce to the veneer 5.

As described above, according to the second embodiment, even if the piercing unit 7 abuts an inclined surface of the top veneer 5 of the piled veneers, the piercing unit 7 is stably adapted to the inclination, so that the piercing members 7*a* and 7*b* pierce the veneer 5 to hoist it.

Figure 15:
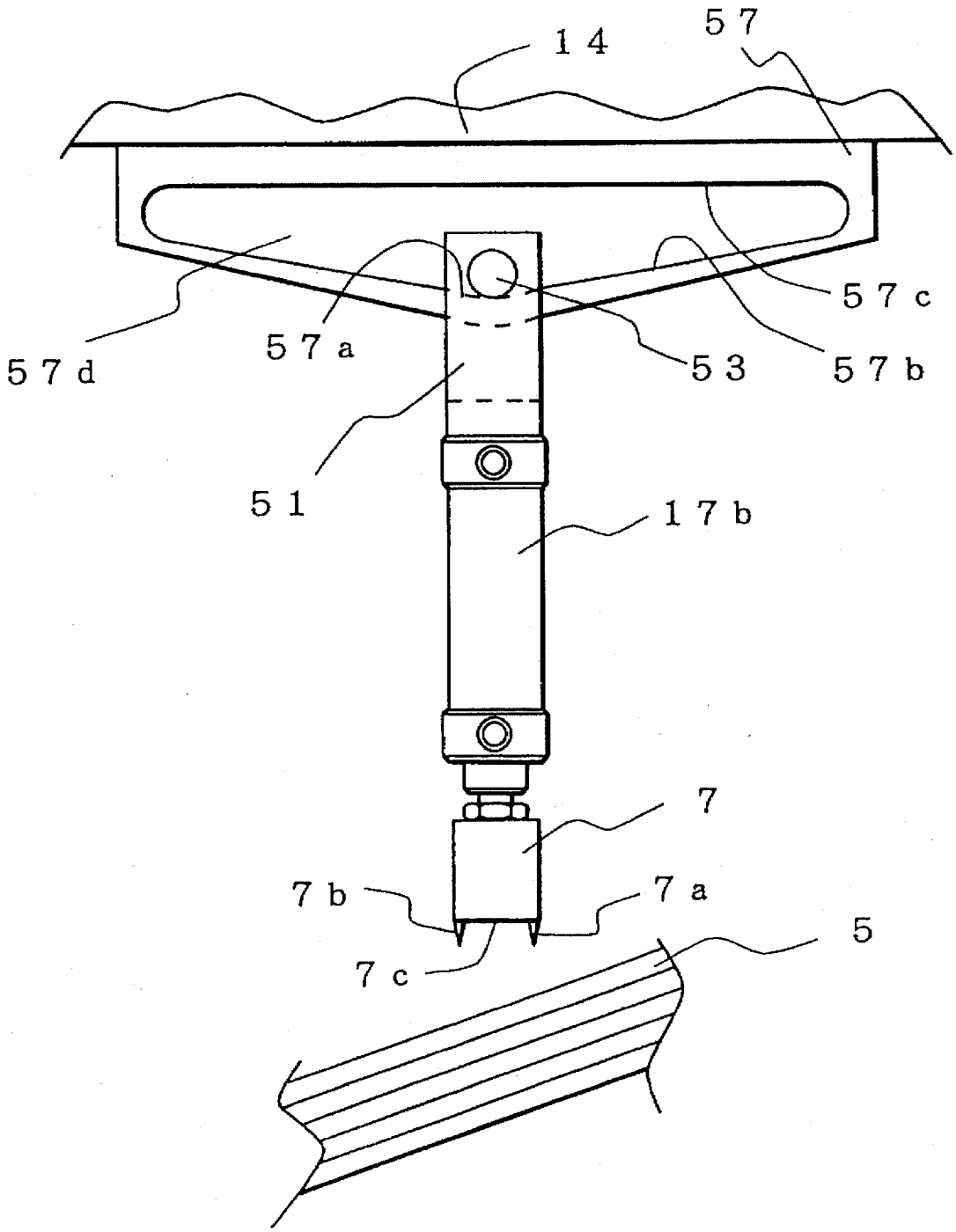
FIG. 15 is a front view of a primary portion of the veneer hoisting apparatus according to the third embodiment of the present invention.
Figure 16:
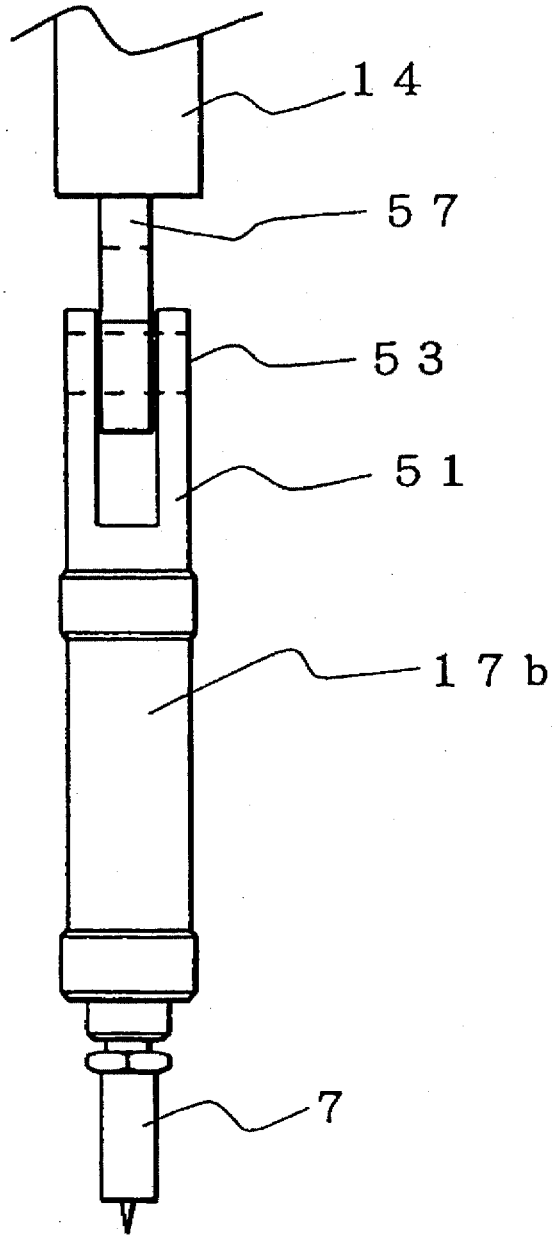
Figure 17:
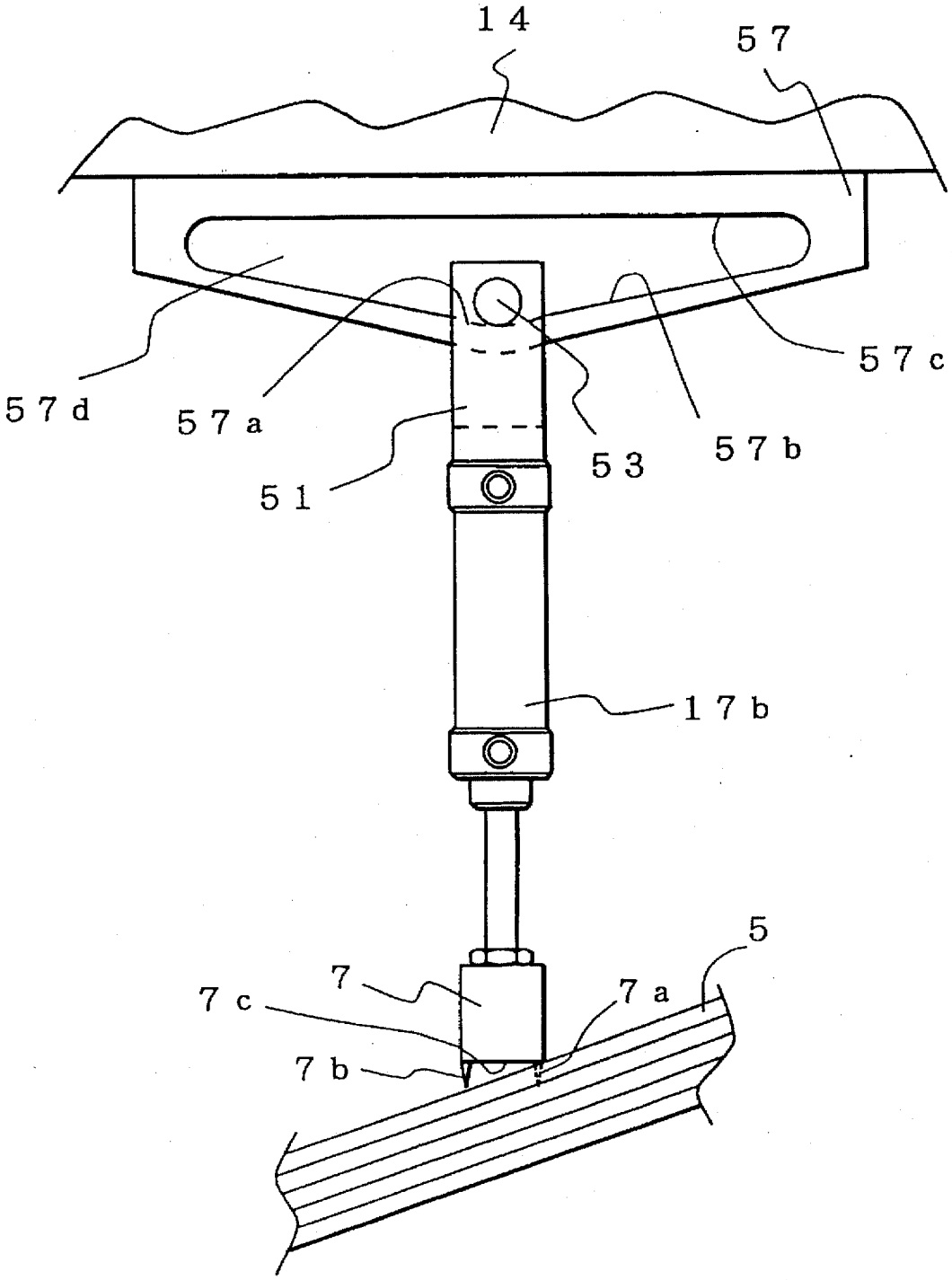
FIG. 17 is a view for explaining the motion of the primary portion of the veneer hoisting apparatus according to the third embodiment.
Figure 18:
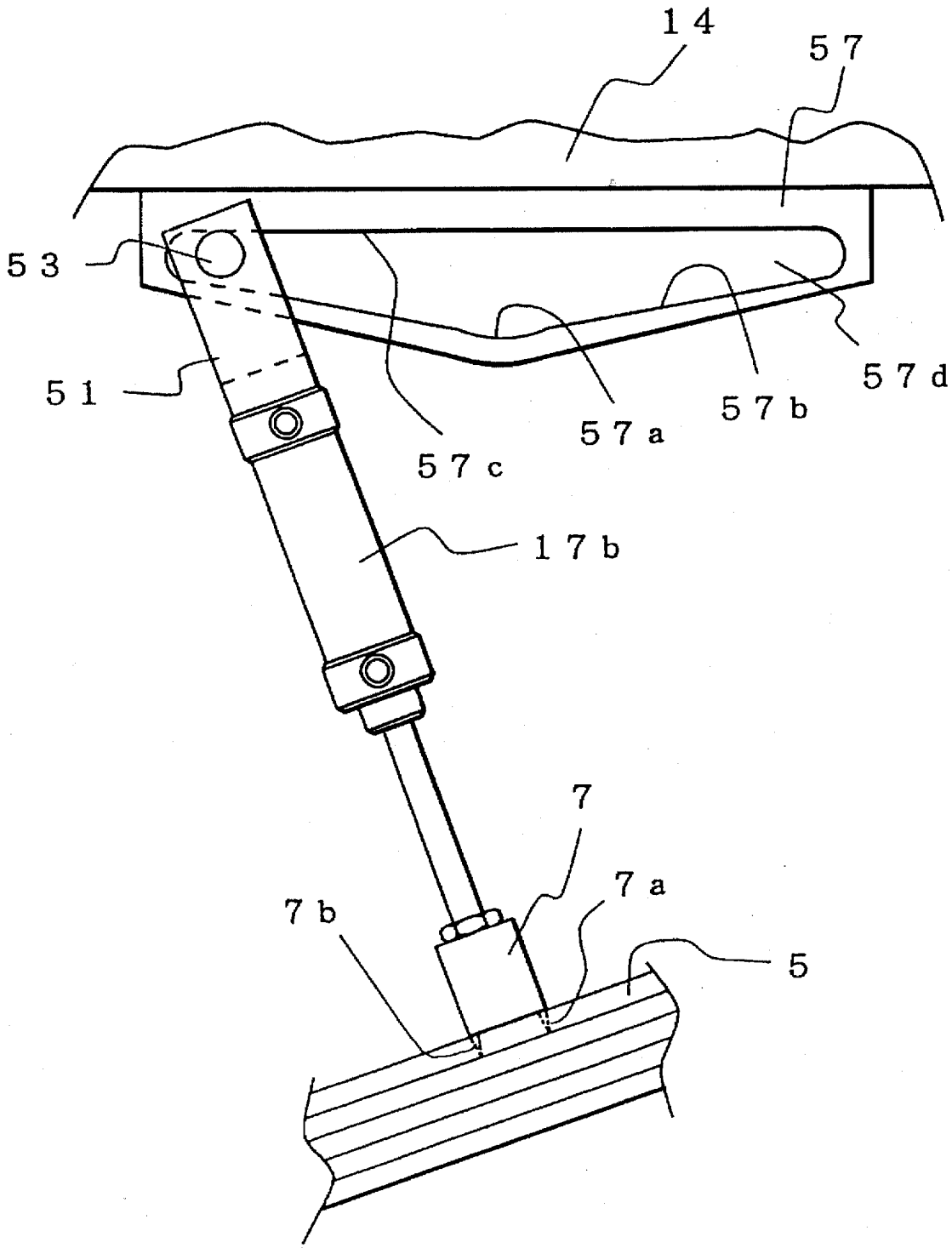
FIG. 18 is a side view of the veneer hoisting apparatus shown in FIG. 15.

Next, the third embodiment according to the present invention will be explained with reference to FIGS. 15 to 18. FIGS. 15 is a front view of a primary portion of the veneer hoisting apparatus according to the third embodiment, and the FIG. 16 is a side view of the veneer hoisting apparatus shown in FIG. 15, and FIGS. 17 and 18 illustrate the motion of the veneer hoisting apparatus. Constructions and motion of elements other than the primary portion is the same as those of veneer hoisting apparatus according to the first embodiment, so the explanation thereof will be omitted.

Like the first embodiment, numeral 7 is a piercing unit with sharp piercing members 7*a* and 7*b*, and 17*b* is an elevating cylinder for the piercing unit 7 as an elevating member. The piston rod of the elevating cylinder 17*b* and the piercing unit 7 are connected to each other. The elevating cylinder 17*b* is provided with a rotation preventing mechanism for the piston rod. Numeral 57 is a guide support member for guiding the elevating cylinder 17*b* substantially horizontally. The guide support member 57 is attached to the auxiliary frame 14. The guide supporting member 57 is provided with an upper portion 57*c*, an inclined portion 57*b*, a lower portion 57*a* and a space 57*d*. The lower portion 57*a* is positioned lower than the extensions line of the right and left inclined portions. The guide shaft 53 is rotatably supported by or fixed to a mounting portion 51 of the elevating cylinder 17*b* while penetrating the space 57*d* (FIGS. 15 and 16). In the initial state illustrated in FIG. 15, the piston rod of the elevating cylinder 17*b* is retracted, and the guide shaft 53 is positioned on the lower portion 57*a* of the guide supporting member 57 due to weight of the elevating cylinder 17*b* and the piercing unit 7, so that the elevating cylinder 17*b* and the piercing unit 7 are vertically maintained.

With the construction described above, like the first embodiment, when a signal from the controller causes the piston rod of the elevating cylinder 17*b* to be extended, the piercing unit 7 falls and the piercing member 7*a* abuts the veneer 5 (FIG. 17). If the surface of the veneer 5 which abuts the piercing member 7*a* is inclined, only the piercing member 7*a* pierces the top veneer 5, then the mounting portion 51 or the guide shaft 53, or both of them are guided left by the guide supporting member 57, so that the piercing unit 7, the elevating cylinder 17*b* and others rotate counterclockwise about the piercing member 7*a*. Further, as the piston rod continues to be extended, the piercing unit 7 is adapted to the inclination of the veneer 5 to allow the piercing member 7*b* to pierce the veneer 5, so that the bottom portion 7*c* of the piercing unit 7 contacts the veneer 5 (FIG. 18). The contact causes the rotation of the elevating cylinder 17*b* and the elevating cylinder 17 to be ceased. After that, even if the piercing unit 7 slightly falls, the relative position between the piercing unit 7 and the veneer 5 does not change, which allows only one veneer 5 to be pierced through the piercing members 7*a* and 7*b*.

After the time required for the extension of the piston rod passes, like the first embodiment, a signal from the controller causes the piston rod to be retracted, and the piercing unit 7 and the elevating cylinder 17*a* rotate clockwise due to their own weight while the piercing unit 7, which pierces the veneer 5 by the piercing members 7*a* and 7*b*, elevates, and the guide shaft moves right along the inclined portion 57*b* of the guide supporting member 57 to return the initial state, and simultaneously the piercing unit 7 and the elevating cylinder 17*b* rotates clockwise. The motion after that is the same as the first embodiment, so the explanation. Will be omitted.

As described above, with the third embodiment, even if the piercing unit 7 abuts an inclined surface of the top veneer 5 of the piled veneers, the piercing unit 7 is adapted to the inclination to pierce the veneer 5 with the piercing members 7*a* and 7*b* to hoist it.

Figure 19:
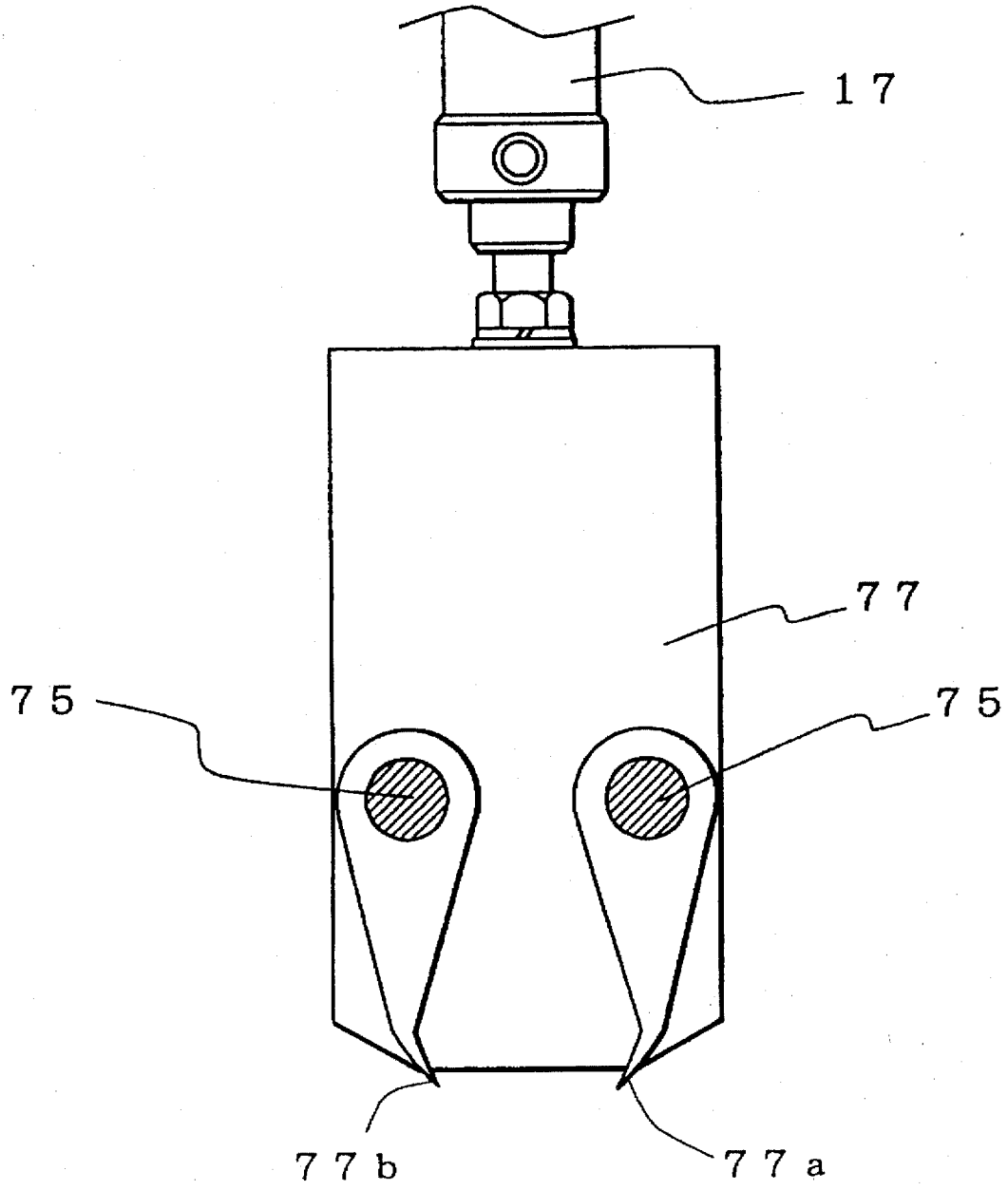
FIG. 19 is a drawing showing another modification of the piercing unit 7, and the piercing members 7*a* and 7*b*.

In the first to third embodiments, the piercing members 7*a* and 7*b* are integrally formed with the piercing unit 7 as separate parts, however, as illustrated in FIG. 19, the piercing members 77*a* and 77*b* may rotatably be attached to the piercing unit 77 through a shaft 75.

With the present invention described above, even if the piercing member abuts an inclined surface of the top veneer, of piled veneers, the piercing unit can stably be adapted to the inclination of the surface to pierce and hoist the top veneer.

What is claimed is:

1. A veneer hoisting apparatus for hoisting veneers from a top one of piled veneers comprising:

a piercing unit with a sharp piercing member;

an elevating member for vertically moving the piercing unit non-rotatably fixed thereto;

supporting means for supporting the elevating member, said supporting means having an angle adjusting mechanism for adjusting an angle between the piercing member and said top veneer when the piercing unit contacts the top veneer such that said piercing member is continuously maintained substantially perpendicular to said top veneer while hoisting a top veneer from a pile; and a controller for controlling motion of the elevating member.

2. The veneer hoisting apparatus as claimed in claim 1, wherein said supporting means includes a guide support member for rotatably supporting said elevating member about an axis which is in parallel with a line extending in a direction of fiber of the veneer, said guide support member having an inclined portion for guiding said elevating member in a direction of the inclined portion.

3. A veneer hoisting apparatus for hoisting veneers from a top one of piled veneers comprising:

a piercing unit with a sharp piercing member;

an elevating member for vertically moving the piercing unit fixed thereto;

supporting means for supporting the elevating member, said supporting means having an angle adjusting mechanism for adjusting an angle between the piercing member and said top veneer when the piercing unit contacts the top veneer; and a controller for controlling motion of the elevating member;

a returning mechanism comprising:

a supporting portion fixed to a transporting means which supports a second supporting means; and a plurality of elastic members situated on opposite sides of said second supporting means, each of said elastic members is fixed to the supporting portion at an end thereof, and fixed to the second supporting means at the other end thereof.

4. The veneer hoisting apparatus as claimed in claim 3, wherein said elastic members include tension springs.

5. A veneer hoisting apparatus for hoisting veneers from a top one of piled veneers comprising:

a piercing unit with a sharp piercing member non-rotatably attached to the piercing unit;

an elevating member for vertically moving the piercing unit fixed thereto;

supporting means for supporting the elevating member, said supporting means having an angle adjusting mechanism for adjusting an angle between the piercing member and said top veneer when the piercing unit contacts the top veneer; and a controller for controlling motion of the elevating member;

said supporting means includes a rotary supporting member for rotatably supporting the elevating member about a lower axis which is in parallel with a line extending in a direction of fiber of the veneer, said rotary supporting member being rotatable about an upper axis which is in parallel with a line extending in a direction of the fiber of the veneer.

6. The veneer hoisting apparatus as claimed in claim 5, wherein said rotary supporting member and said elevating member are connected to each other with a universal joint.

7. A veneer hoisting apparatus for hoisting veneers from a top one of piled veneers comprising:

a piercing unit with a sharp piercing member;

an elevating member for vertically moving the piercing unit fixed thereto;

supporting means for supporting the elevating member, said supporting means having an angle adjusting mechanism for adjusting an angle between the piercing member and said top veneer when the piercing unit contacts the top veneer; and a controller for controlling motion of the elevating member;

said supporting means comprising:

a first supporting member for supporting said elevating member;

a second supporting member for rotatably supporting said first supporting member about an axis which is in parallel with a line extending in a direction of fiber of the veneer, said second supporting member usually staying at a predetermined position, and moving in a direction perpendicular to the fiber of the veneer when a force stronger than a predetermined value is applied to said second supporting member; and a returning mechanism for returning the second supporting member to said predetermined position in a direction perpendicular to the fiber of the veneer.

8. A veneer hoisting apparatus for hoisting veneers from a top one of piled veneers comprising:

a piercing unit with a sharp piercing member;

an elevating member for vertically moving the piercing unit fixed thereto;

supporting means for supporting the elevating member, said supporting means having an angle adjusting mechanism for adjusting an angle between the piercing member and said top veneer when the piercing unit contacts the top veneer; and a controller for controlling motion of the elevating member;

said supporting means includes a guide support member for rotatably supporting said elevating member about an axis which is in parallel with a line extending in a direction of fiber of the veneer;

said guide support member comprising;

a lower central portion with ascending inclined surfaces on both sides of the central portion; and stoppers for restricting movement of said elevating member at both ends of said inclined surface.

* * * * *